US008293692B2

(12) United States Patent
Ikai

(10) Patent No.: US 8,293,692 B2
(45) Date of Patent: Oct. 23, 2012

(54) LUBRICATING OIL COMPOSITION

(75) Inventor: Tohru Ikai, Tokyo (JP)

(73) Assignee: Shell Oil Company, Houston, TX (US)

( * ) Notice: Subject to any disclaimer, the term of this patent is extended or adjusted under 35 U.S.C. 154(b) by 76 days.

(21) Appl. No.: 12/373,741

(22) PCT Filed: Jul. 18, 2007

(86) PCT No.: PCT/EP2007/057429

§ 371 (c)(1),
(2), (4) Date: Jan. 29, 2009

(87) PCT Pub. No.: WO2008/009704

PCT Pub. Date: Jan. 24, 2008

(65) Prior Publication Data

US 2009/0312209 A1 Dec. 17, 2009

(30) Foreign Application Priority Data

Jul. 19, 2006 (JP) ..... 2006-196884

(51) Int. Cl.

| | |
|---|---|
| ***C10M 105/36*** | (2006.01) |
| ***C10M 137/10*** | (2006.01) |
| ***C10M 141/10*** | (2006.01) |
| ***C10M 111/04*** | (2006.01) |

(52) U.S. Cl. ..... 508/496; 508/370; 508/371; 508/440; 508/442; 508/499

(58) Field of Classification Search ..... 508/370, 508/371, 440, 442, 499, 461
See application file for complete search history.

(56) References Cited

U.S. PATENT DOCUMENTS

| | | | | |
|---|---|---|---|---|
| 3,640,872 | A | 2/1972 | Wiley et al. | 252/75 |
| 5,599,779 | A | 2/1997 | Karol et al. | 508/283 |
| 6,043,199 | A | 3/2000 | Godici | 508/285 |
| 6,410,490 | B1 * | 6/2002 | Reyes-Gavilan et al. | 508/243 |
| 2004/0031256 | A1 * | 2/2004 | Rollins, III | 60/39.182 |
| 2004/0053794 | A1 * | 3/2004 | Baba | 508/430 |
| 2006/0197345 | A1 * | 9/2006 | Kuroki et al. | 290/1 A |

FOREIGN PATENT DOCUMENTS

| | | |
|---|---|---|
| JP | 7228882 | 8/1995 |
| WO | WO02092735 | 11/2002 |

* cited by examiner

*Primary Examiner* — Ellen McAvoy
*Assistant Examiner* — Vishal Vasisth

(57) ABSTRACT

The present invention provides a lubricating oil composition comprising at least one type of base oil selected from mineral oils and synthetic oils, and a succinate ester and a sarcosinic acid as rust prevention agents. The succinate ester content is preferably set at 0.01 to 0.1 wt. %, and the sarcosinic acid content is preferably set at 0.001 to 0.01 wt. %. Further, they are preferably set such that the resulting weight ratio of the succinate ester content and sarcosinic acid content is 1:0.01 to 0.7. The lubricating oil composition according to the present invention shows excellent rust prevention properties and a satisfactorily long oxidation lifetime. Further it allows to attain a high level of anti-sludge performance and extreme pressure performance and lubrication performance, even when it is used for example in turbine bearings in combined cycle generators having multiplier gears operated under severe high temperature and high pressure conditions.

9 Claims, No Drawings

LUBRICATING OIL COMPOSITION

PRIORITY CLAIM

The present application claims priority from PCT/EP2007/057429, filed 18 Jul. 2007, which claims priority from Japanese Patent Application 2006-196884 filed 19 Jul. 2006.

Field of the Invention

The present invention relates to a lubricating oil composition.

BACKGROUND OF THE INVENTION

In recent electricity generating installations, for high power generation efficiency and effective energy use, there has been increasing use of gas turbines using a high temperature combustion gas such as liquefied natural gas (LNG) or combined cycle generating installations in which a gas turbine and a steam turbine are combined. In these electricity generating installations, with the increasingly high combustion gas temperatures, the thermal load on the turbine oils used has greatly increased.

Further, in the case of combined cycle electricity generation burning blast furnace gas (BFG), because the combustion calories from BFG are low, it is necessary greatly to increase the pressure of the BFG in order to increase the power generation efficiency. Because of this, the BFG is fed into the gas turbine after compression in a gas compressor connected with the shaft system made up of gas turbine-electricity generator-steam turbine via a multiplier gear.

In this multiplier gear, the gas compressor and turbine shaft and electricity generator are directly connected; however, to make the turbine plant more compact, it has become a requirement that the turbine bearing lubricating oil and the multiplier gear lubricating oil can be used for both purposes. For such a lubricating oil, performance both as a turbine oil and as a gear oil is required, and gear antiwear properties and extreme pressure properties are strongly required. Moreover, excellent rust prevention properties are required, and it is also required to have excellent thermal and oxidation stability and anti-sludge performance under severe high temperature and high surface pressure conditions.

Because of this, gas turbine oils have previously been proposed (see fore example Japanese Laid-Open Specification No. 7-228882) wherein an alkylated diphenylamine, alkylated phenyl-a-naphthylamine and benzotriazole are incorporated into a mineral oil or synthetic oil; however, satisfactory effects had not yet been obtained with these.

As stated above, when previous lubricating oils were used in the turbine bearings of combined cycle generators having an aforesaid multiplier gear, their anti-sludge performance and extreme pressure properties could not always be described as satisfactory. That is to say, in applications where excellent rust prevention properties, excellent extreme pressure properties and antiwear properties were required, lubricating oils to which sulphur type extreme pressure additives such as zinc dialkyldithiophosphates or sulphur-phosphorus type extreme pressure additives such as alkylated thiophosphates, and, as rust prevention agents, Ca sulphonates or Ba sulphonates and the like, are added are widely used; however, since by their nature the rust prevention agents have excellent adsorption onto metal surfaces, there is a high probability that they will impair the lubricating performance-improving action of the various extreme pressure additives, hence it is very difficult to reconcile extreme pressure properties with rust prevention properties.

In particular, in applications where lubricating agents are used at high temperature, even when the quantity of sulphur type extreme pressure agent added is extremely small, large amounts of sludge tend to be formed if the thermal load is increased, and the thermal stability and oxidation stability tend to decrease. Because of this, with lubricating oils with added sulphur type extreme pressure agents it is difficult to obtain satisfactory thermal stability, oxidation stability and anti-sludge performance in the turbine bearings of combined cycle generators having the aforesaid multiplier gears.

On the other hand, although less sludge tends to form with the phosphorus type extreme pressure additives than with the sulphur type extreme pressure additives, it is difficult to obtain the high level extreme pressure properties required in the aforesaid gear bearings if the phosphorus type extreme pressure additives are used alone.

SUMMARY OF THE INVENTION

The present invention now provides an excellent lubricating oil composition which displays a sufficiently long oxidation lifetime, and has excellent rust prevention properties, a high level of anti-sludge properties and excellent extreme pressure properties, even when used for example in the turbine bearings of combined cycle generators having multiplier gears operated in a severe high temperature and high pressure environment.

The present inventors, as a result of diligent and repeated studies with the aim of achieving the aforesaid purpose, found that through the simultaneous use of a succinate ester and a sarcosinic acid as carefully selected rust prevention agents in at least one type of base oil selected from mineral oils and synthetic oils, it is possible to reduce the quantity added of rust prevention agents that readily impair the extreme pressure properties, and yet obtain a lubricating oil composition having excellent rust prevention properties. Moreover, by the further incorporation of phosphorus compounds and aromatic amine compounds in the base oil, it is possible to display satisfactorily long oxidation lifetimes, and yet obtain a lubricating oil composition having a high level of anti-sludge properties and excellent extreme pressure properties.

By means of the lubricating oil compositions of the present invention, it is possible to obtain excellent rust prevention properties even when they are used for lubrication both of gears and bearings for example in the turbine bearings of combined cycle generators having multiplier gears operated under severe high temperature and high pressure conditions. Further, as lubricating oils they display a satisfactorily long oxidation lifetime, and it becomes possible to attain a high level of anti-sludge properties and extreme pressure properties. Consequently, the lubricating oil compositions of the present invention are extremely valuable for inhibition of sliding part wear for example in multiplier gears, for prevention of seizing, and for extending the maintenance intervals of the turbine bearing units in combined cycle generators and the like.

Below, optimal modes for implementation of the present invention are described in detail. It should be noted that, in the following descriptions, if compounds or functional groups can assume both a linear and a branched structure, unless specifically excluded, the said compounds include both the linear and the branched substances.

DETAILED DESCRIPTION OF PREFERRED EMBODIMENTS

The lubricating oil compositions of the present invention contain at least one type of base oil selected from mineral oils and synthetic oils.

As mineral oils, for example paraffinic or naphthenic oils refined by subjecting a lubricating oil fraction, obtained by atmospheric distillation and low pressure distillation of crude oil, to a suitable combination of refining processes such as solvent deasphalting, solvent extraction, hydrocracking, solvent dewaxing, catalytic dewaxing, hydrorefining, sulphuric acid washing and clay treatment can be mentioned.

As synthetic oils, for example, polyolefins, alkylbenzenes, alkylnaphthalenes, esters, poly-oxyalkylene glycols, polyphenyl ethers, dialkyl diphenyl ethers, fluorine-containing compounds (perfluoro polyethers, fluorinated polyolefins and the like), silicone oils and the like are mentioned.

Further, for example wax isomerisation oils, base oils produced by techniques wherein GTL wax (gas-to-liquid wax) is isomerised, and the like, can also be used.

As highly refined synthetic oils, lubricating base oils having a viscosity index of 130 or more (typically 145 to 155), obtained using heavy linear paraffins from Fischer-Tropsch polymerisation of the raw materials hydrogen and carbon monoxide obtained by gasification processes (partial oxidation) on natural gas (methane and the like), and subjecting this to catalytic cracking and isomerisation in the same way as aforesaid, the base oils referred to as GTL (gas-to-liquid), and the like can also be used.

Among these base oils, since they are more heat resistant and have excellent thermal and oxidation stability, mineral oils whose sulphur content and nitrogen content have been decreased as far as possible by hydrogenation processes and the like, and synthetic oil polyolefins or the synthetic oil called XHVI (registered trademark) (GTL (gas-to-liquid)) are preferably used.

The aforesaid polyolefins include polymers of different olefins, or hydrogenation products thereof. Any olefin can be used, and for example ethylene, propylene, butene (1-butene, 2-butene, isobutene), α-olefins with 5 or more carbons and the like are mentioned. In the production of the polyolefins, one type of aforesaid olefin can be used alone, and combinations of two or more types can also be used.

There is no particular restriction as to the content of the aforesaid base oils in the lubricating oil compositions of the present invention, and, based on the total weight of the lubricating oil composition, it is preferably 60 wt. % or more, more preferably 70 wt. % or more, even more preferably 80 wt. % or more, and still more preferably 90 wt. % or more.

Although there is no particular restriction as to the viscosity of the aforesaid base oils, the kinematic viscosity at 40° C. is preferably 2 to 680 $mm^2$/sec, and more preferably 8 to 220 $mm^2$/sec.

Further, the total sulphur content is preferably 0 to 100 ppm, more preferably 0 to 30 ppm. The total nitrogen content is also preferably 0 to 100 ppm, more preferably 0 to 30 ppm.

Further, those with an aniline point of 80 to 150° C., preferably 110-135° C., are preferably used.

The lubricating oil compositions according to the present invention are made by incorporating both a succinate ester and a sarcosinic acid into the aforesaid base oils as rust prevention agents.

The aforesaid succinate esters are preferably the part esters of succinic acid and 1-30 carbon alcohols shown in the following formula 1.

[Chem. 1]

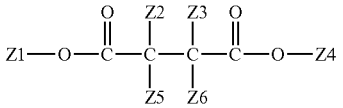

(1)

(in the aforesaid formula 1, Z1-Z6 mean hydrogen atom or 1-30 carbon linear or branched alkyl group or alkenyl group).

Further, the aforesaid sarcosinic acids are preferably the glycine derivatives shown by the following formula 2.

[Chem. 2]

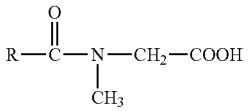

(2)

(in the aforesaid formula 2, R means a 1-30 carbon linear or branched alkyl group or alkenyl group).

As a concrete example of the aforesaid sarcosinic acids, (Z)-N-methyl-N-(1-oxo-9-octadecenyl)glycine of the following formula 3 and the like are mentioned.

[Chem. 3]

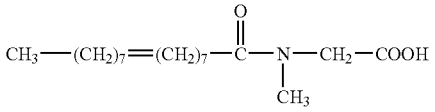

(3)

The aforesaid succinate esters are preferably used at a content of 0.01 to 0.1 wt. %, relative to the total weight of lubricating oil composition. Further, the aforesaid sarcosinic acids are preferably used at a content of 0.001 to 0.01 wt. %, on a similar basis.

Also, they are preferably used such that the weight ratio of succinate ester and sarcosinic acid is 1:0.01 to 0.7, preferably 1:0.02 to 0.5, more preferably 1:0.05 to 0.3.

A phosphorus compound is preferably incorporated in this lubricating oil composition in order further to improve the extreme pressure properties.

This phosphorus compound is preferably at least one type of phosphate ester, acid phosphate ester, acid phosphate ester amine salt, chlorinated phosphate ester, phosphite ester, phosphorothionate, zinc dithiophosphate, ester of dithiophosphoric acid and an alkanol or polyether alcohol or a derivative thereof, phosphorus-containing carboxylic acid or phosphorus-containing carboxylate ester, or a mixture thereof, and with regard to thermal and oxidation stability it is preferably used.

As concrete examples of phosphate esters, tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tris(iso-propylphenyl)phosphate, triallyl phosphate, tricresyl phosphate, trixylenyl phosphate, cresyl diphenyl phosphate, xylenyl diphenyl phosphate and the like are mentioned.

As concrete examples of acid phosphate esters, monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, dioleyl acid phosphate and the like are mentioned.

As acid phosphate ester amine salts, salts of the aforesaid acid phosphate esters with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine are mentioned.

As chlorinated phosphate esters, tris-dichloropropyl phosphate, tris-chloroethyl phosphate, tris-chlorophenyl phosphate, polyoxyalkylene-bis[di(chloroalkyl)]phosphates and the like are mentioned.

As phosphite esters, dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, tricresyl phosphite and the like are mentioned.

Further, as concrete examples of phosphorothionates, tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyl diphenyl phosphorothionate, xylenyl diphenyl phosphorothionate, tris(n-propylphenyl)phosphorothionate, tris(isopropylphenyl)phosphorothionate, tris(n-butylphenyl)phosphorothionate, tris(isobutylphenyl)phosphorothionate, tris(s-butylphenyl)phosphorothionate, tris(t-butylphenyl) phosphorothionate and the like are mentioned. Further, mixtures thereof can also be used.

As zinc dithiophosphates, in general zinc dialkyl dithiophosphates, zinc diaryl dithio-phosphates, zinc arylalkyl dithiophosphates and the like are mentioned by way of example. For example, as regards the alkyl groups of the zinc dialkyl dithiophosphates, zinc dialkyl dithiophosphates having 3-22 carbon primary or secondary alkyl groups or alkylaryl groups substituted with a 3-18 carbon alkyl group are used.

As concrete examples of zinc dialkyl dithiophosphates, zinc dipropyl dithiophosphate, zinc dibutyl dithiophosphate, zinc dipentyl dithiophosphate, zinc dihexyl dithiophosphate, zinc diisopentyl dithiophosphate, zinc diethylhexyl dithiophosphate, zinc dioctyl dithiophosphate, zinc dinonyl dithiophosphate, zinc didecyl dithiophosphate, zinc didodecyl dithiophosphate, zinc dipropylphenyl dithiophosphate, zinc dipentylphenyl dithiophosphate, zinc dipropylmethylphenyl dithiophosphate, zinc dinonylphenyl dithiophosphate, zinc didodecylphenyl dithiophosphate, zinc didodecyl dithiophosphate and the like are mentioned.

As dithiophosphate esters or derivatives thereof, the following are mentioned by way of example. Monoalkyl dithiophosphate esters (the alkyl groups may be linear or branched) such as monopropyl dithiophosphate, monobutyl dithiophosphate, monopentyl dithiophosphate, monohexyl dithiophosphate, monoheptyl dithiophosphate, monooctyl dithiophosphate and monolauryl dithiophosphate, mono((alkyl)aryl) dithiophosphate esters such as monophenyl dithiophosphate and monocresyl dithiophosphate, dialkyl dithiophosphate esters (the alkyl groups may be linear or branched) such as dipropyl dithiophosphate, dibutyl dithiophosphate, dipentyl dithiophosphate, dihexyl dithiophosphate, diheptyl dithiophosphate, dioctyl dithiophosphate and dilauryl dithiophosphate, di((alkyl)aryl)dithiophosphate esters such as diphenyl dithiophosphate and dicresyl dithiophosphate, trialkyl dithiophosphate esters (the alkyl groups may be linear or branched) such as tripropyl dithiophosphate, tributyl dithiophosphate, tripentyl dithiophosphate, trihexyl dithiophosphate, triheptyl dithiophosphate, trioctyl dithiophosphate and trilauryl dithiophosphate, tri((alkyl)aryl)dithiophosphate esters such as triphenyl dithiophosphate and tricresyl dithiophosphate can be stated by way of example.

Further, there is no particular restriction as to the phosphorus-containing carboxylic acid compound, provided that it contains both a carboxyl group and a phosphorus atom in the same molecule. However, with regard to extreme pressure properties, and thermal and oxidation stability, phosphorylated carboxylic acids or phosphorylated carboxylate esters are preferable.

As phosphorylated carboxylic acids and phosphorylated carboxylate esters, for example the compounds represented by the following formula 4 are mentioned.

[Chem. 4]

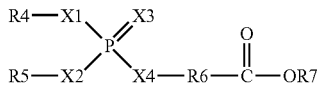

(4)

(in formula 4, R4 and R5 may be the same or different, and each represent a hydrogen atom or a 1-30 carbon hydrocarbon group, R6 represents a 1-20 carbon alkylene group, R7 represents a hydrogen atom or a 1-30 carbon hydrocarbon group, the number of carbons X1, X2, X3 and X4 may be the same or different and each represent an oxygen atom or sulphur atom).

In the aforesaid formula 4, R4 and R5 each represent a hydrogen atom or 1-30 carbon hydrocarbon group, and as the 1-30 carbon hydrocarbon group, alkyl groups, alkenyl groups, aryl groups, alkylaryl groups, arylalkyl groups and the like are mentioned.

Among the aforesaid phosphorylated carboxylic acids, the valuable β-dithiophosphorylated propionic acids have the structure in the following formula 5.

[Chem. 5]

(5)

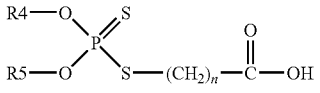

As concrete examples of these dithiophosphorylated propionic acids, 3-(di-isobutoxy-thiophosphorylsulphanyl)-2-methyl-propionic acid and the like are mentioned.

There is no particular restriction as to the content of the phosphorus-containing carboxylic acid compound in the present lubricating oil composition, but it is preferably 0.001 to 1 wt. %, more preferably 0.002 to 0.5 wt. %, based on the total weight of the lubricating oil composition.

With a phosphorus-containing carboxylic acid compound content less than the aforesaid lower limit, satisfactory lubricating properties tend not to be obtained. On the other hand, if it exceeds the aforesaid upper limit, lubricating property-improving effects corresponding to the content tend not to be obtained; furthermore, it is undesirable since there is a risk of a decrease in the thermal and oxidation stability and stability to hydrolysis.

Now, the content of compounds among the phosphorylated carboxylic acids represented by the aforesaid formula (4) wherein R7 is a hydrogen atom is preferably 0.001 to 0.1 wt. %, more preferably 0.002 to 0.08 wt. %, still more preferably 0.003 to 0.7 wt. %, even more preferably 0.004 to 0.06 wt. %, and particularly preferably 0.005 to 0.05 wt. %.

If the said content is less than 0.001, there is a risk that the extreme pressure property-improving effects will be insufficient, and on the other hand, if it exceeds 0.1 wt. %, there is a risk that the thermal and oxidation stability will decrease.

Among the aforesaid phosphorus compounds, since they are superior in performance such as extreme pressure properties, phosphate esters, acid phosphate esters, acid phosphate ester amine salts, chlorinated phosphate esters, phosphite esters, phosphorothionates and β-dithiophosphorylated propionic acids are preferable, phosphate esters and β-dithiophosphorylated propionic acids are more preferable, and triaryl phosphates such as triphenyl phosphate, tricresyl phosphate, monocresyl diphenyl phosphate and dicresyl monophenyl phosphate, and β-dithiophosphorylated propionic acids are still more preferable.

There is no particular restriction as to the content of the aforesaid phosphorus compound, however it is preferably 0.01 to 5 wt. %, more preferably 0.05 to 4.5 wt. %, still more preferably 0.1 to 4 wt. %, even more preferably 0.5 to 3.5 wt. %, and particularly preferably 1.0 to 3 wt. %, based on the total weight of the lubricating oil composition. If the content of phosphorus compound is less than 0.01 wt. %, there is a risk that the extreme pressure property-improving effect due to the phosphorus compound content will become insufficient; on the other hand, if it exceeds 5 wt. %, there is a risk that the thermal and oxidation stability and the foaming properties will decline.

An aromatic amine compound can also be incorporated into this lubricating oil composition, and as such aromatic amine compounds, phenyl-a-naphthylamine compounds and dialkyl-diphenylamine compounds are mentioned.

As the phenyl-α-naphthylamine compound, the phenyl-α-naphthylamine compounds shown in the following formula 6 are preferably used.

[Chem. 6]

(6)

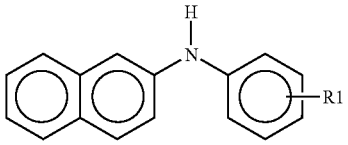

(in the aforesaid formula 6, R1 represents a hydrogen atom or 1-16 carbon linear or branched alkyl group).

If R1 in the aforesaid formula 6 is an alkyl group, this alkyl group is 1-16 carbon linear or branched. As concrete examples of such alkyl groups, methyl, ethyl, propyl, butyl, pentyl, hexyl, heptyl, octyl, nonyl, decyl, undecyl, dodecyl, tridecyl, tetradecyl, pentadecyl, hexadecyl and the like are mentioned. If the number of carbons in R1 exceeds 16, the percentage of the functional group in the molecule becomes small, and there is a risk that this will have an adverse effect on antioxidant performance.

If R1 in the general formula 6 is an alkyl group, for excellent solubility, R1 is preferably an 8-16 carbon branched alkyl group, moreover, 8-16 carbon branched alkyl groups derived from oligomers of 3 or 4 carbon olefins are more preferable. As specific 3 or 4 carbon olefins, propylene, 1-butene, 2-butene and isobutylene are mentioned, and, with regard to solubility, propylene or isobutylene are preferable.

Furthermore, in order to obtain excellent solubility, as R1, a branched octyl group derived from isobutylene dimer, a branched nonyl group derived from propylene trimer, a branched dodecyl group derived from isobutylene trimer, a branched dodecyl group derived from propylene tetramer or a branched pentadecyl group derived from propylene pentamer are still more preferable, and the branched octyl group derived from isobutylene dimer, branched dodecyl group derived from isobutylene trimer and branched dodecyl group derived from propylene tetramer are particularly preferable.

Further, if R1 is an alkyl group, it can be attached to any position of the phenyl group, but the p-position relative to the amino group is preferable. Furthermore, the amino group can be attached to any position of the naphthyl group, but the α position is preferable.

As the phenyl-α-naphthylamine represented by the aforesaid general formula (6), commercial products can be used, and synthesised products can also be used. The synthesised products can easily be synthesised using a Friedel-Crafts catalyst, by reacting phenyl-α-naphthylamine and a 1-16 carbon halogenated alkyl compound, or by reacting phenyl-α-naphthylamine and a 2-16 carbon olefin or 2-16 carbon olefin oligomer. As concrete examples of Friedel-Crafts catalysts, metal halides such as aluminium chloride, zinc chloride and iron chloride, acid catalysts such as sulphuric acid, phosphoric acid, phosphorus pentoxide, boron fluoride, acid clay and activated clay, and the like, can be used.

Further, as dialkyldiphenylamine compounds, the dialkyldiphenylamines shown in the following formula 7 are preferably used.

[Chem. 7]

(7)

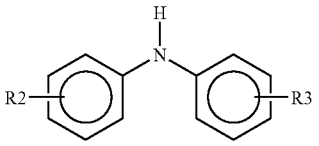

(in formula 7, R2 and R3 may be the same or different, and each represent a 1-16 carbon alkyl group).

As concrete examples of alkyl groups represented by these R2 and R3, methyl, ethyl, propyl, butyl, pentyl, hexyl, heptyl, octyl, nonyl, decyl, undecyl, dodecyl, tridecyl, tetradecyl, pentadecyl, hexadecyl and the like are mentioned (these alkyl groups can be linear or branched).

Among these, for excellent solubility, as R2 and R3, 3-16 carbon branched alkyl groups are preferable, and 3-16 carbon branched alkyl groups derived from 3 or 4 carbon olefins or oligomers thereof are more preferable. As concrete examples of 3 or 4 carbon olefins, propylene, 1-butene, 2-butene and isobutylene are mentioned, and with regard to excellent solubility, propylene or isobutylene are preferable.

Further, as R2 or R3, since more superior solubility is obtained, respectively an isopropyl group derived from propylene, a tert-butyl group derived from isobutylene, a branched hexyl group derived from propylene dimer, branched octyl group derived from isobutylene dimer, branched nonyl group derived from propylene trimer, branched dodecyl group derived from isobutylene trimer, branched dodecyl group derived from propylene tetramer, or branched pentadecyl group derived from propylene pentamer are still more preferable, and the tert-butyl group derived from isobutylene, branched hexyl group derived from propylene dimer, branched octyl group derived from isobutylene dimer, branched nonyl group derived from propylene trimer, branched dodecyl group derived from isobutylene trimer or branched dodecyl group derived from propylene tetramer are most preferable.

If compounds wherein one or both of R2 or R3 are hydrogen atoms are used, there is a risk of sludge formation owing to oxidation of the said compounds themselves. Further, if the number of carbons in the alkyl group(s) exceeds 16, the percentage of the functional group in the molecule becomes small, and there is a risk that this will diminish the antioxidant performance at high temperature.

The alkyl groups represented by R2 or R3 can be attached to any position of the respective phenyl groups, but the p-position relative to the amino group is preferable, in other words, the dialkyldiphenylamine compounds represented by the aforesaid formula 7 are preferably p,p'-dialkyldiphenylamines.

As the dialkyldiphenylamines represented by the aforesaid formula 7, commercial products can be used, and synthesised products can also be used. The synthesised products can easily be synthesised using a Friedel-Crafts catalyst, by reacting diphenylamine and a 1-16 carbon halogenated alkyl compound and diphenylamine, or by reacting diphenylamine and a 2-16 carbon olefin or a 2-16 carbon olefin or oligomer thereof. As the Friedel-Crafts catalyst, the metal halides or acid catalysts and the like given by way of example in the description of the phenyl-α-naphthylamine compounds can be used.

The aromatic amine compounds represented by the aforesaid formulae (6) and (7) can be used alone or as mixtures of two or more of different structure, however, since antioxidant properties at high temperature can be anticipated over a long period, a phenyl-α-naphthylamine represented by the formula (6) and a dialkyldiphenylamine represented by the formula (7) are preferably used together. The mixing ratio in this case is arbitrary, but it is preferably in the weight ratio range 1/10 to 10/1.

Further, although there is no particular restriction as to the total content of aromatic amine compounds in the lubricating oil compositions of the present invention, it is preferably 0.01 to 5.0 wt. %, more preferably 0.02 to 4.0 wt. %, still more preferably 0.03 to 3.0 wt. %, yet more preferably 0.04 to 2.0 wt. %, and particularly preferably 0.05 to 1.0 wt. %, based on the total weight of the lubricating oil composition. If the total content is less than 0.01 wt. %, the oxidation stability and thermal stability tend to become insufficient. On the other hand, if it exceeds 5.0 wt. %, this is undesirable as an oxidation stability effect corresponding to the content is not obtained, and furthermore it is a factor causing an increase in sludge.

For the purpose of further improving their performance, one alone or a combination of two or more known lubricating oil additives can be added to the lubricating oil compositions of the present invention. As examples of such additives, antioxidants such as phenols or pheno-thiazones, antifoaming agents such as acrylates, e.g. polyacrylates, or siloxanes, e.g. alkyl polysiloxanes, metal deactivating agents such as benzotriazole or derivatives thereof, pour point depressants such as polymethacrylates, polyisobutenes, olefin copolymers and polystyrenes and the like are mentioned.

The content of these additives when used is arbitrary, and, based on the composition total weight, is preferably 0.1 to 5 wt. % for antioxidants, 0.0005 to 1 wt. % for antifoaming agents, 0.005 to 1 wt. % for metal deactivating agents, and 0.1 to 15 wt. % each for other additives.

Although there is no particular restriction as to the viscosity of the present lubricating oil compositions, the kinematic viscosity at 100° C. is preferably 25 $mm^2$/sec or lower, more preferably 20 $mm^2$/sec or lower, still more preferably 15 $mm^2$/sec or lower, and particularly preferably 10 $mm^2$/sec or lower. Further, the kinematic viscosity at 100 is preferably 1.0 $mm^2$/sec or higher, more preferably 1.5 $mm^2$/sec or higher, still more preferably 2.0 $mm^2$/sec or higher, and particularly preferably 2.5 $mm^2$/sec or higher. Further, although there is no particular restriction as to the viscosity index of the aforesaid base oils, it is preferably 85 or higher, more preferably 100 or higher, and still more preferably 120 or higher.

Further, in the lubricating oil compositions of the present invention, to increase thermal and oxidation stability, and in particular for adequate reduction of sludge formation, the sulphur content (calculated as the element) in the said compositions is preferably 0.02 wt. % or less, more preferably 0.015 wt. % or less and still more preferably 0.01 wt. % or less, based on the composition total weight. The "sulphur content" referred to here means the value measured by the JIS K2541 "Crude Oil and Petroleum Products—Sulphur Content Test Methods", "Microcoulometric Titration Oxidation Method".

Although there is no particular restriction as to the uses of the lubricating oil compositions of the present invention, they are particularly preferably used as lubricating oils for turbine devices fitted with compressors and multiplier gears. Turbine devices include water-powered turbines, steam turbines, gas turbines, and the like, however the lubricating oils of the present invention manifest particularly excellent effects when used in gas turbine devices fitted with multiplier gears. There is no particular restriction as to the output number of such gas turbine devices.

Further, because of their superior properties, apart from the aforesaid application, the lubricating oil compositions of the present invention can also preferably be used in applications such as for hydraulic actuating oils, industrial gear oils, bearing oils and compressor oils.

PRACTICAL EXAMPLES

Below, the present invention is more specifically explained on the basis of practical examples and comparison examples; however, the present invention is in no way limited to the following practical examples.

Practical Examples 1-2

Comparison Examples 1-8

For the preparation of Practical Examples 1-2 and Comparison Examples 1-6, the following base oils and additives were procured.

Base Oil 1: Gr III (XHVI 5.2) (Registered Trademark) Highly hydrocracked base oil (Properties: kinematic viscosity at 100° C., 5.38 $mm^2$/sec, viscosity index: 145, sulphur content (calculated as elemental sulphur): less than 10 wt. ppm), obtained using wax separated by solvent dewaxing (slack wax) as the raw material, and isomerising the linear paraffins to branched paraffins by hydrocracking this in the presence of a catalyst (catalytic cracking).

Base Oil 2: Gr II

Paraffinic mineral oil (Properties: kinematic viscosity at 100° C., 10.9 $mm^2$/sec, viscosity index: 104, sulphur content (calculated as elemental sulphur): less than 10 wt. ppm), obtained by subjecting a lubricating oil fraction obtained by atmospheric pressure distillation of crude oil to a suitable combination of refining processes such as hydro-cracking and solvent dewaxing.

Additive A1: alkenylsuccinate ester

Additive A2: oleylsarcosinic acid

Additive B1: β-dithiophosphorylated propionic acid

Additive B2: tris(iso-propylphenyl)phosphate

Additive C1: alkylated phenylnaphthylamine

Additive C2: octylated & butylated diphenylamine

Additive C3: tris(di-t-butylphenyl)phosphite

Additive D: benzotriazole

Additive E: alkylpolyalkoxy ester

Using the aforesaid base oils and additives, the lubricating oil compositions of Practical Examples 1-2 and Comparison Examples 1-6 having the compositions shown in Tables 1-4 were prepared, and commercial gas turbine oils were procured for Comparison Examples 7 and 8.

Measurement of Viscosity, etc.

For the lubricating oil compositions of the aforesaid Practical Examples 1-2 and Comparison Examples 1-8, the kinematic viscosity at 40° C. (on basis of JIS K2283), kinematic viscosity at 100° C. (on basis of JIS K2283), viscosity index (on basis of JIS K2283) and acid value (on basis of JIS K2501) were measured. The measurement results are shown in Tables 1-4.

Testing

Using the lubricating oil compositions of Practical Examples 1-2 and Comparison Examples 1-8, the following tests were performed to examine their performance.

Rust Prevention Testing

On the basis of JIS K2510, 300 ml of sample oil were placed in a vessel installed in a thermostated oven, and stirred at 1000 rpm. When it reached 60° C., an iron test piece was inserted into the sample oil, 30 ml of artificial seawater were then added, and the stirring was continued for 24 hours, while maintaining at 60° C., after which the test piece was taken out, and the rust formation status of the test piece assessed visually.

Assessment criteria:

No rust: Rust formation not seen (0%)

Slight: 6 or fewer rust points, of 1 mm or less

Medium: Exceeds aforesaid slight grade, less than 5% of surface area

Severe: Exceeds aforesaid moderate grade, 5% of surface area or more

Extreme Pressure Properties Testing

Using the test methods standardised in ASTMD 5182-91, the FZG gearwheel lubricating performance test was performed, and the extreme pressure properties of each lubricating oil composition assessed. In the FZG gearwheel test, the load stage which resulted in failure was taken as the lubricating oil performance assessment indicator.

Thermal & Oxidation Stability Testing: Dry TOST Test

In the test specified in JIS K2514 TOST (Turbine oil oxidation stability test), without addition of water, a test oil volume of 360 ml was taken, heated to 120° C. in an oil bath, and oxygen blown in at a flow rate of 3 l/hr while maintaining this temperature. As the catalyst, a coil-shaped copper or iron catalyst was used. After 500 hrs, counting from the start of oxygen blowing, the test oil was cooled to room temperature, then the entire volume of the oxidation-degraded lubricating oil composition was filtered through a 1.0 μm aperture membrane filter, the insoluble fraction on the filter was weighed, and the quantity of sludge measured as the number of mg of insoluble fraction per 100 ml of test oil, i.e. in mg/100 ml.

RPVOT Test

The oxidation lifetime of the filtered oil after completion of the aforesaid Dry TOST test was measured by the method standardised in the same JIS standard test RPVOT. The RPVOT residual percentage was obtained by dividing the RPVOT value of the oxidation-degraded oil after the oxidation test by the previously measured RPVOT value of the new oil. The greater the RPVOT value of the oxidation-degraded oil, and the lower the weight of insoluble fraction relative to the RPVOT residual percentage, the more satisfactory are the thermal and oxidation stability.

Test Results

The test results are shown in Tables 1-4. For Comparison Examples 1-4, in the rust prevention properties test, there was slight to severe rust formation according to the criteria for this, and it was judged that these could not be used as turbine oils. Consequently, the FZG gearwheel test and Dry TOST tests were not performed.

Further, for Comparison Examples 5-6, although no rust formation was seen in the rust prevention properties test, the results in the FZG gearwheel test were FLS 8 for Comparison Example 5 and FLS 7 for Comparison Example 6, these did not fulfil the FLS 9 or greater criterion required for oils for combined use as turbine oils and gear oils, and it was judged that they were unsuitable as oils for combined use as turbine oils and gear oils. Consequently, the Dry TOST test was not performed.

Evaluation

As is clear from the results shown in Table 1, in the rust prevention properties test, no rust formation was seen with either of the lubricating oil compositions of Practical Examples 1 and 2, in which a succinate ester and a sarcosinic acid were used together as rust prevention agents, and it was judged that they display excellent rust prevention properties. Further, the results in the FZG gearwheel test were satisfactory, FLS11 (Practical Example 1) and FLS10 (Practical Example 2), hence they showed excellent extreme pressure properties, the quantity of sludge in the Dry TOST test was also low, 2.9 mg/100 ml (Practical Example 1) and 1.9 mg/100 ml (Practical Example 2), hence it was confirmed that they have anti-sludge properties and a satisfactorily long oxidation lifetime, and it was judged that Practical Examples 1 and 2 are suitable as oils for combined use as turbine oils and gear oils.

As shown in Tables 2-4, in Comparison Examples 1-6 either one of a succinate ester or a sarcosinic acid was used as the rust prevention agent, and, as aforesaid, either there was slight to severe rust formation in the rust prevention properties test, according to the criteria for this, (Comparison Examples 1-4), or, while no rust formation was seen, the results in the FZG gearwheel test were low, FLS 8 and FLS 7 (Comparison Examples 5 and 6), and they were unsuitable for use as oils for combined use as turbine oils and gear oils.

Further, with the commercial gas turbine oil A of Comparison Example 7, although no rust formation was seen in the rust prevention properties test, and good results also emerged from the FZG gearwheel test, FLS12, the quantity of sludge in the Dry TOST test, 73 mg/100 ml, was very large, and with the commercial gas turbine oil B of Comparison Example 8, although no rust formation was seen in the rust prevention properties test, and the quantity of sludge was also comparatively small, the result in the FZG gearwheel test was low, FLS 8, and neither could be said to have satisfactory performance.

TABLE 1

| | | Pract. Ex. 1 | Pract. Ex. 2 |
|---|---|---|---|
| Base oil I | | 70.885 | 70.985 |
| Base oil II | | 28.0 | 28.0 |
| Additive A1 | | 0.04 | 0.04 |
| Additive A2 | | 0.005 | 0.005 |
| Additive B1 | | 0.03 | 0.03 |
| Additive B2 | | 0.7 | 0.5 |
| Additive C1 | | 0.2 | 0.2 |
| Additive C2 | | 0.1 | 0.1 |
| Additive C3 | | | 0.1 |
| Additive D | | 0.03 | 0.03 |
| Additive E | | 0.01 | 0.01 |
| Viscosity $mm^2/s$ @40° C. | J I S K 2283 | 32.0 | 32.2 |
| Viscosity $mm^2/s$ ®100° C. | J I S K 2283 | 6.07 | 6.08 |
| Viscosity index | J I S K 2283 | 139 | 139 |
| Acid value mg KOH/g | J I S K 2501 | 0.11 | 0.10 |
| RPVOT @ 150° C. mins | J I S K 2514 | 1,710 | 1,910 |
| Rust prevention @60° C. (artificial seawater) | J I S K 2510 | no rust | no rust |
| F Z G (FLS) | ASTM D5182 | 11 | 10 |
| Dry TOST 120° C. × 500 hrs RPVOT (mins) | JISK 2514 Standard | 1,090 | 1,320 |
| Residual percentage (%) | | 64% | 69% |
| Sludge (1 μm) mg/100 ml | | 2.9 | 1.9 |

TABLE 2

| | | Comp. Ex. 1 | Comp. Ex. 2 | Comp. Ex. 3 |
|---|---|---|---|---|
| Base oil I | | 71.09 | 71.125 | 70.99 |
| Base oil II | | 28.0 | 28.0 | 28.0 |
| Additive A1 | | 0.04 | | 0.04 |
| Additive A2 | | | 0.005 | |
| Additive B1 | | 0.03 | 0.03 | 0.03 |
| Additive B2 | | 0.5 | 0.5 | 0.5 |
| Additive C1 | | 0.2 | 0.2 | 0.2 |
| Additive C2 | | 0.1 | 0.1 | 0.1 |
| Additive C3 | | | | 0.1 |
| Additive D | | 0.03 | 0.03 | 0.03 |
| Additive E | | 0.01 | 0.01 | 0.01 |
| Viscosity $mm^2/s$ @40° C. | J I S K 2283 | 31.9 | 31.9 | 31.9 |
| Viscosity $mm^2/s$ @100° C. | J I S K 2283 | 6.04 | 6.04 | 6.05 |
| Viscosity index | J I S K 2283 | 138 | 138 | 139 |
| Acid value mg KOH/g | J I S K 2501 | 0.14 | 0.07 | 0.11 |
| RPVOT @ 150° C. mins | J I S K 2514 | 1,780 | 1,760 | 1.940 |
| Rust prevention @60° C. (artificial seawater) | J I S K 2510 | medium | severe | slight |
| F Z G (FLS) | ASTM D5182 | — | — | — |
| Dry TOST 120° C. × 500 hrs RPVOT (mins) | JISK 2514 Standard | — | — | — |
| Residual percentage (%) | | | | |
| Sludge (1 μm) mg/100 ml | | | | |

TABLE 3

| | | Comp. Ex. 4 | Comp. Ex. 5 | Comp. Ex. 6 |
|---|---|---|---|---|
| Base oil I | | 71.025 | 70.985 | 71.00 |
| Base oil II | | 28.0 | 28.0 | 28.0 |
| Additive A1 | | | 0.045 | |
| Additive A2 | | 0.005 | | 0.03 |
| Additive B1 | | 0.03 | 0.03 | 0.03 |
| Additive B2 | | 0.5 | 0.5 | 0.5 |
| Additive C1 | | 0.2 | 0.2 | 0.2 |
| Additive C2 | | 0.1 | 0.1 | 0.1 |
| Additive C3 | | 0.1 | 0.1 | 0.1 |
| Additive D | | 0.03 | 0.03 | 0.03 |
| Additive E | | 0.01 | 0.01 | 0.01 |
| Viscosity $mm^2/s$ @40° C. | J I S K 2283 | 32.0 | 31.6 | 32.0 |
| Viscosity $mm^2/s$ @100° C. | J I S K 2283 | 6.06 | 6.01 | 6.06 |
| Viscosity index | J I S K 2283 | 139 | 139 | 139 |
| Acid value mg KOH/g | J I S K 2501 | 0.05 | 0.12 | 0.05 |
| RPVOT @ 150° C. mins | J I S K 2514 | 2,150 | 1,970 | 1,850 |
| Rust prevention @60° C. (artificial seawater) | J I S K 2510 | severe | no rust | no rust |
| F Z G (FLS) | ASTM D5182 | — | 8 | 7 |
| Dry TOST 120° C. × 500 hrs RPVOT (mins) | JISK 2514 Standard | | | |
| Residual percentage (%) | | | | |
| Sludge (1 μm) mg/100 ml | | | | |

TABLE 4

| | | Comp. Ex. 7 | Comp. Ex. 8 |
|---|---|---|---|
| Base oil I | | Commercial gas turbine oil A | Commercial gas turbine oil B |
| Base oil II | | | |
| Additive A1 | | | |
| Additive A2 | | | |
| Additive B1 | | | |
| Additive B2 | | | |
| Additive C1 | | | |
| Additive C2 | | | |
| Additive C3 | | | |
| Additive D | | | |
| Additive E | | | |
| Viscosity $mm^2/s$ @40° C. | J I S K 2283 | 31.9 | 31.1 |
| Viscosity $mm^2/s$ @100° C. | J I S K 2283 | 6.13 | 5.55 |
| Viscosity index | J I S K 2283 | 144 | 116 |
| Acid value mg KOH/g | J I S K 2501 | 0.18 | 0.08 |
| RPVOT @ 150° C. mins | J I S K 2514 | 1,100 | 1,770 |
| Rust prevention @60° C. (artificial seawater) | J I S K 2510 | no rust | no rust |
| F Z G (FLS) | ASTM D5182 | 12 | 8 |
| Dry TOST 120° C. × 500 hrs | JISK 2514 | | |
| RPVOT (mins) | Standard | 620 | 1,310 |
| Residual percentage (%) | | 56% | 74% |
| Sludge (1 μm) mg/100 ml | | 73 | 9.0 |

What is claimed is:

1. A method of improving the lubrication in a combined cycle generator having a multiplier gear, by lubricating said combined cycle generator having a multiplier gear with a lubricating oil composition comprising at least one type of base oil selected from mineral oils and synthetic oils, and a succinate ester and sarcosinic acid as rust prevention agents, wherein the aforesaid base oil displays a kinematic viscosity of 8 to 220 $mm^2$/sec (40° C.), total sulphur content 0 to 30 ppm, total nitrogen content 0 to 30 ppm and aniline point 110 to 135° C., and wherein the content of the aforesaid succinate ester is 0.01 to 0.1 wt % relative to the total weight of lubricating oil composition, and the content of a sarcosinic acid is 0.001 to 0.01 wt % relative to the total weight of lubricating oil composition, and wherein the weight ratio of the aforesaid succinate ester content and a sarcosinic acid content is 1:0.01 to 0.7.

2. A method according to claim 1, further containing at least one type of phosphorus compound.

3. A method according to claim 2 wherein the aforesaid phosphorus compound is selected from the group comprising a phosphate ester, acid phosphate ester, acid phosphate ester amine salt, chlorinated phosphate ester, phosphite ester, phosphorothionate, zinc dithiophosphate, dithiophosphate ester or derivative thereof, phosphorus-containing carboxylic acid, or phosphorus-containing carboxylate ester; or a mixture thereof.

4. A method according to claim 3 wherein the aforesaid phosphorus-containing carboxylic acid or phosphorus-containing carboxylate ester is β-dithio-phosphorylated propionic acid or a β-dithiophosphorylated propionate ester.

5. A method according to claim 1 further containing an aromatic amine compound.

6. A method according to claim 5 wherein the aforesaid aromatic amine compound is at least one of a phenyl-α-naphthylamine compound or a dialkyldiphenylamine compound.

7. A method according to claim 1, wherein the combined cycle generator burns blast furnace gas, and wherein within the combined cycle generator, a gas compressor is connected with a shaft system made up of a gas turbine, an electricity generator, and a steam turbine via the multiplier gear.

8. A method according to claim 1, wherein said lubricating oil composition is used in the multiplier gear of the combined cycle generator for inhibition of sliding part wear.

9. A method according to claim 8, wherein said lubricating oil composition is used as both a turbine bearing lubricating oil and multiplier gear lubricating oil within the combined cycle generator.

* * * * *